US006516892B2

(12) United States Patent
Reilly

(10) Patent No.: US 6,516,892 B2
(45) Date of Patent: Feb. 11, 2003

(54) METHOD AND APPARATUS FOR COILED TUBING OPERATIONS

(75) Inventor: Patrick J. Reilly, Eagle River, AK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/892,022

(22) Filed: Jun. 26, 2001

(65) Prior Publication Data

US 2002/0195255 A1 Dec. 26, 2002

(51) Int. Cl.[7] ..... E21B 19/22

(52) U.S. Cl. ..... 166/384; 166/385; 166/77.2; 242/566; 242/387; 242/393; 242/397.1; 242/397.5

(58) Field of Search ..... 242/593, 128, 242/557, 566, 387, 390.3, 393, 397.1, 397.5; 166/384, 385, 77.1, 77.2, 77.3

(56) References Cited

U.S. PATENT DOCUMENTS

| | | | | |
|---|---|---|---|---|
| 3,272,455 A | * | 9/1966 | Sternberg et al. | |
| 3,895,764 A | * | 7/1975 | Roland | 242/107.6 |
| 4,515,220 A | | 5/1985 | Sizer et al. | 166/384 |
| 4,890,957 A | * | 1/1990 | Rinas | 405/174 |
| 4,914,775 A | * | 4/1990 | Kirk | 15/104.33 |
| 5,660,235 A | | 8/1997 | Burge et al. | 166/385 |
| 5,738,173 A | | 4/1998 | Sola | 166/384 |
| 6,092,756 A | | 7/2000 | Sola | 242/399.2 |

* cited by examiner

*Primary Examiner*—William Neuder
(74) *Attorney, Agent, or Firm*—Hovey Williams LLP; Kameron D. Kelly

(57) ABSTRACT

A coiled tubing rig is operable to simultaneously translate and rotate coiled tubing in a borehole.

35 Claims, 5 Drawing Sheets

METHOD AND APPARATUS FOR COILED TUBING OPERATIONS

BACKGROUND OF THE INVENTION

1. Field of the Invention

The present invention relates generally to coiled tubing operations. In another aspect, the present invention concerns a system for simultaneously translating and rotating coiled tubing in a bore. In a further aspect, the present invention concerns a system which employs simultaneously translating and rotating coiled tubing to drill a borehole in a subterranean formation.

2. Description of the Prior Art

Oil and gas wells have traditionally been drilled using a string of substantially ridged, rotatable steel pipe sections having a drill bit attached to the end of the string. A significant disadvantage of this type of rotary drilling system is the amount of time consumed when it is necessary to remove the drill string from the borehole in order to perform operations such as replacing the drill bit or setting casing. Because individual sections of pipe must be unscrewed when removing the drill string from the borehole, it can take hours, or even days, to remove the drill string from the borehole. Further, because individual sections of pipe must be screwed together when reinserting the drill string into the borehole, it can consume additional hours, or even days, to reinsert the drill string into the borehole.

In recent years, drillers have discovered an alternative to traditional rotary drilling. This alternative employs coiled tubing rather than rigid sections of steel pipe. Coiled tubing is a continuous length of flexible tubing which can be stored on a reel. Each reel may contain 10,000 feet or more of continuous coiled tubing. Coiled tubing can be used to drill a borehole by attaching a hydraulic motor and drill bit to its downhole end and then charging pressurized drilling fluid to the tubing. The pressurized drilling fluid drives the hydraulic motor which, in turn, rotates the drill bit. The drill bit and hydraulic motor are lowered into the borehole as the coiled tubing is spooled off the reel to thereby drill the borehole.

A significant advantage of coiled tubing drilling is that the coiled tubing can be raised and lowered in the borehole at rates up to ten times faster than those possible with conventional rotary drilling techniques. This increased "tripping" speed is primarily attributable to the fact that coiled tubing can be tripped without screwing or unscrewing individual sections. A further advantage of coiled tubing drilling is the enhanced ability to control downhole pressure. This ability to control downhole pressure provides for numerous advantages associated with underbalanced drilling.

However, one significant disadvantage of conventional coiled tubing drilling is the inability to rotate the tubing in the borehole. The fact that the coiled tubing does not rotate relative to the borehole means that all of the energy for rotating the drill bit must be supplied by the pressurized drilling mud which drives the hydraulic motor. Further, lack of rotation of the coiled tubing in the borehole causes increased friction between the walls of the borehole and the coiled tubing. This increased friction can make it difficult to translate the tubing in the borehole. Further, the increased friction between the coiled tubing and the borehole may require more frequent tripping of the tubing.

SUMMARY OF THE INVENTION

In accordance with an embodiment of the present invention, an apparatus for shifting an elongated flexible working member between a wound position on a reel and an extended position in a receiving opening is provided. The apparatus comprises a guide member, a first powering device, and a second powering device. The guide member is adapted to direct the working member between the wound position and the extended position. The first powering device is adapted to selectively rotate the reel on a reel axis. The second powering device is adapted to selectively move the guide member relative to the reel around the reel axis.

In accordance with another embodiment of the present invention, an apparatus for selectively shifting coiled tubing into and out of a borehole extending into a subterranean formation is provided. The apparatus comprises a reel and a guide member. The reel is adapted to store the coiled tubing in a wound position thereon. The reel includes a reel opening extending therethrough. The guide member is adapted to direct the coiled tubing from the wound position to a position in which the coiled tubing is aligned for extension through the reel opening.

In accordance with a further embodiment of the present invention, a drilling rig for drilling a borehole in a subterranean formation using coiled tubing is provided. The coiled tubing is at least partially disposed in a wound position on a reel. The reel defines a reel axis and a reel opening extending through the reel along the reel axis. The drilling rig comprises a reel support, a guide member, and a power injector. The reel support is adapted to support the reel in a position wherein the reel axis is at least substantially upright. The guide member is adapted to direct the coiled tubing between the wound position and a position in which the coiled tubing is aligned for extension through the reel opening. The power injector is operable to translate the tubing relative to the guide member.

In accordance with a still further embodiment of the present invention, a method of shifting an elongated flexible tubing in and out of a bore is provided. The method comprises the steps of: (a) unwinding a length of the tubing off of a reel around which the tubing is wound; and (b) directing the unwound portion of the tubing through an opening in the reel and into the bore.

In accordance with an even further embodiment of the present invention, a method of drilling a borehole and subterranean formation is provided. The method comprises the steps of: (a) positioning a rotatable reel so that an axis of rotation of the reel is at least substantially upright, said reel having a reel opening which extends through the reel at least substantially along the reel axis of rotation; (b) unwinding a portion of a coiled tubing off of the reel; (c) positioning at least a portion of the unwound coiled tubing in a guide member which directs the unwound coiled tubing generally downward through the reel opening and into an extended position; (d) rotating the guide member relative to the subterranean formation to thereby cause rotation of the coiled tubing the extended position relative to the subterranean formation; and (e) simultaneously with step (d), actuating a power injector to thereby cause translation of the coiled tubing in the extended position relative to the subterranean formation.

Thus, the present invention provides a coiled tubing system which allows the coiled tubing to be simultaneously translated and rotated in the borehole. Other aspects and advantages of the present invention will be apparent from the following detailed description of the preferred embodiment and the accompanying drawings figures.

BRIEF DESCRIPTION OF THE DRAWING FIGURES

A preferred embodiment of the present invention is described in detail below with reference to the attached drawing figures, wherein.

Figures 4, 7:
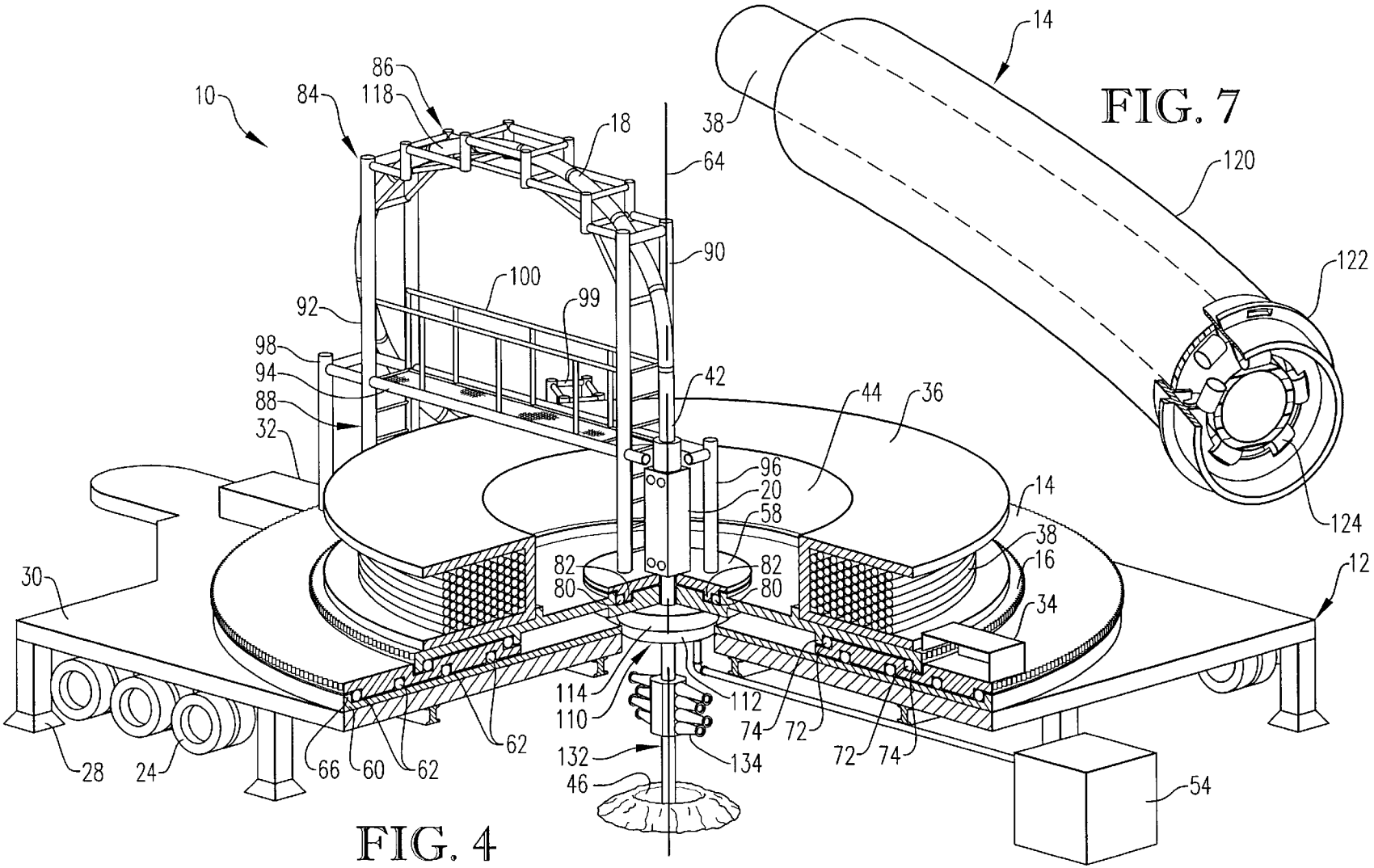
FIG. 4 is a isometric view of the coiled tubing rig with certain sections being cut away to more clearly illustrate the operation of the coiled tubing rig.
Figure 6:
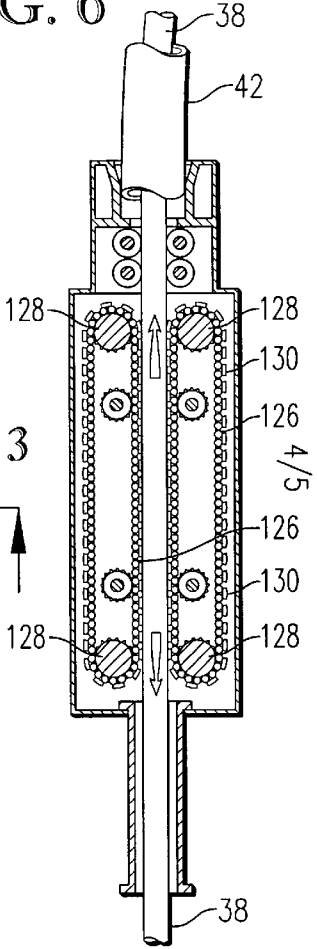

FIG. 6 is a sectional view of a power injector showing a length of coiled tubing positioned therein for translation relative to the power injector; and FIG. 7 is a isometric view of a section of the guide member and a collar for joining adjacent sections of the guide member, with certain portions of the collar being cut away to more clearly illustrate the manner in which the coiled tubing is received in the collar and the guide member section.

DETAILED DESCRIPTION OF THE PREFERRED EMBODIMENTS

Figure 1:
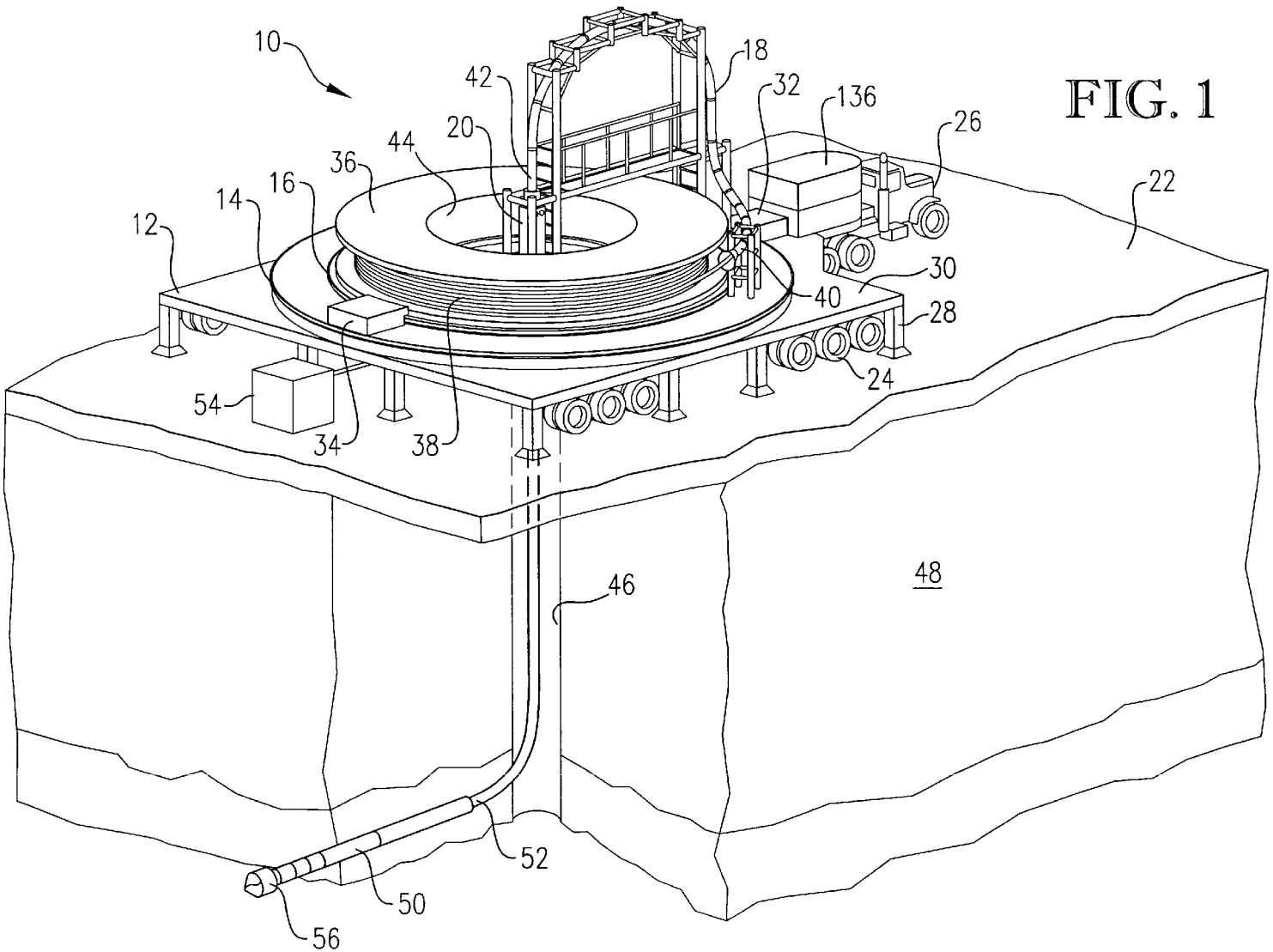
FIG. 1 is an isometric view of a coiled tubing rig according to one embodiment of the present invention, with the coiled tubing rig being shown drilling a borehole in a subterranean formation.
Figure 2:
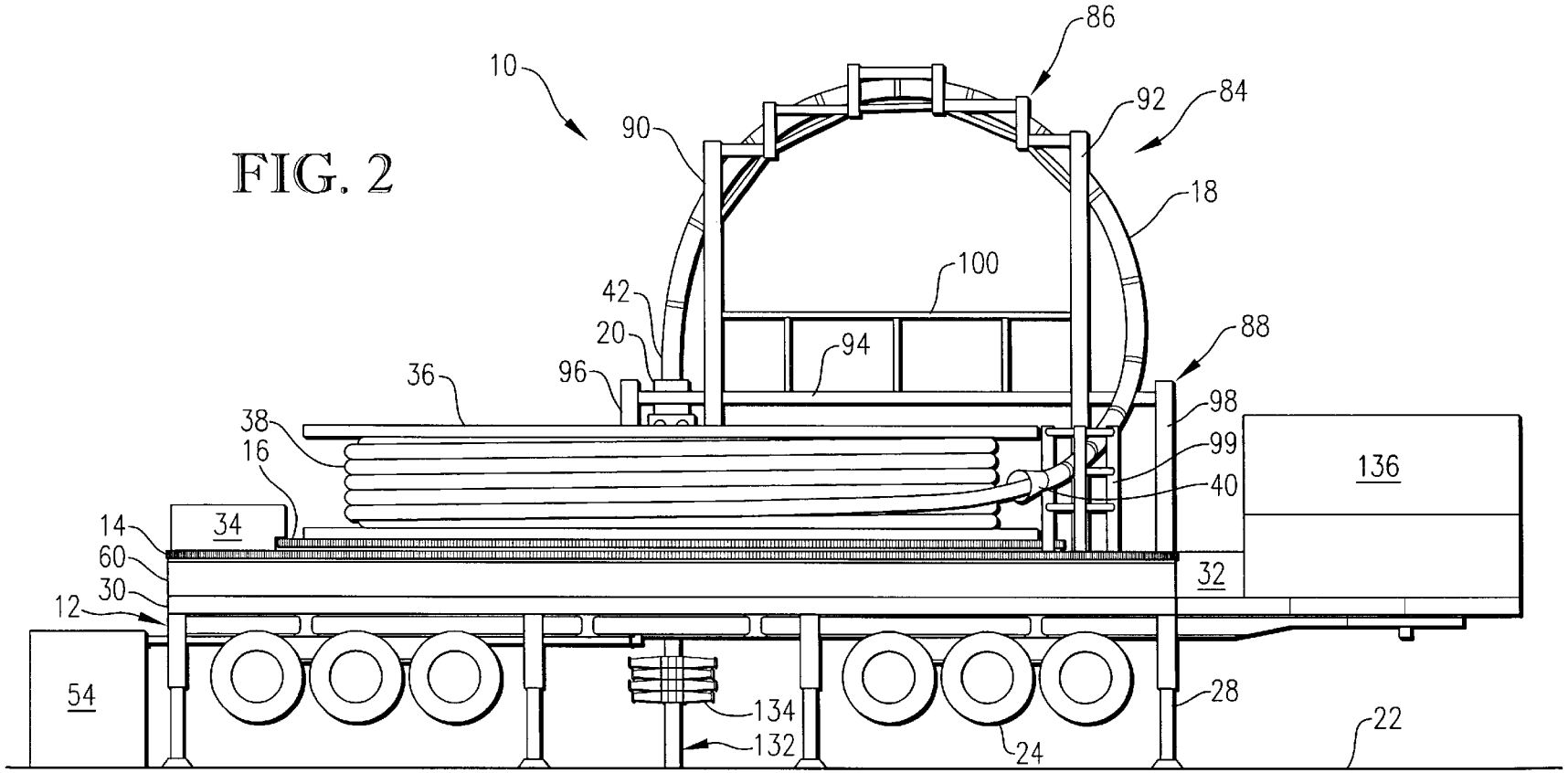
FIG. 2 is a side view of the coiled tubing rig.

Referring initially to FIG. 1, a coiled tubing rig 10 in accordance with present invention is illustrated. Coiled tubing rig 10 generally comprises a ground support structure 12, a guide turntable 14, a reel turntable 16, a guide member 18, and a power injector 20.

Ground support structure 12 is operable to support coiled tubing rig 10 on a ground surface 22. Ground support structure 12 is preferably a mobile structure which can be used to transport coiled tubing rig 10 to various locations via wheels 24 and a towing vehicle 26. Legs 28 of ground support structure 12 are preferably independently extensible hydraulic legs which are coupled to a platform 30. When extended, legs 28 raise wheels 24 above ground surface 22 and support platform 30 relative to ground surface 22 in a generally fixed horizontal position.

Guide turntable 14 is rotatably coupled to platform 30 of ground support structure 12. A guide motor 32 is fixedly coupled to platform 30 and engages guide turntable 14. Guide motor 32 is operable to selectively rotate guide turntable 14 relative to platform 30.

Reel turntable 16 is rotatably coupled to guide turntable 14. A reel motor 34 is fixedly coupled to guide turntable 14 and engages reel turntable 16. Reel motor 34 is operable to selectively rotate reel turntable 16 relative to guide turntable 14. Reel turntable 16 is adapted to support a reel 36 around which a coiled tubing 38 is disposed in a wound position. Reel turntable 16 supports reel 36 for rotation on a reel axis of rotation that is substantially upright. Preferably, the reel axis of rotation is at least substantially vertical. Most preferably, reel turntable 16 supports reel 36 so that the reel axis of rotation is substantially vertically aligned with, and extends into, a borehole 46 in a subterranean formation 48.

Guide member 18 has a first end 40 which is located proximate coiled tubing 38 disposed in a wound position on reel 36. Guide member 18 has a second end 42 which is located proximate an opening 44 extending generally through the center of reel 36 along the reel axis of rotation. Guide member 18 is configured to direct coiled tubing 38 off of reel 36, over reel 36, and into a position in which coiled tubing 38 is aligned for extension through opening 44 and into borehole 46 in subterranean formation 48. Guide member 18 is further configured and supported so that when guide turntable 14 is rotated relative to subterranean formation 48, guide member 18 exerts a torsional force on coiled tubing 38, thereby rotating the portion of coiled tubing 38 extending into borehole 46 relative to subterranean formation 48.

Power injector 20 is coupled to second end 42 of guide member 18 and is operable to longitudinally translate coiled tubing 38 through guide member 18. Power injector 20 can be selectably shifted between an advancing mode, in which coiled tubing 38 is drawn off of reel 36 and inserted into borehole 46, and a retracting mode, in which coiled tubing 38 is drawn up from borehole 46 and wound onto reel 36.

A hydraulic motor 50 is coupled to a downhole end 52 of coiled tubing 38 which is extended into subterranean formation 48. A drilling fluid source 54 can be fluidically coupled to coiling tubing 38 on reel 36 so that pressurized drilling fluid is pumped through coiled tubing 38 to hydraulic motor 50. When powered by the pressurized drilling fluid, hydraulic motor 50 causes a drill bit 56 to rotate relative to subterranean formation 48 and thereby drill borehole 46.

In operation, power injector 20 and reel turntable 16 cooperate to provide translation of coiled tubing 38 relative to subterranean formation 48. Guide turntable 14 and guide member 18 cooperate to provide rotation of coiled tubing 38 relative to subterranean formation 48. Thus, when power injector 20, guide motor 32, and reel motor 34 are simultaneously actuated, coiled tubing rig 10 allows coiled tubing 38 to be simultaneously rotated and translated relative to subterranean formation 48 while, at the same time, drill bit 56 can be rotated relative to coiled tubing 38 by hydraulic motor 50.

Referring now to FIGS. 2–5, the components of coiled tubing rig 10 are described in further detail. As perhaps best illustrated in FIGS. 3 and 4, coiled tubing rig 10 includes three turntables which can be rotated relative to platform 30 - guide turntable 14, reel turntable 16, and an injector turntable 58.

Guide turntable 14 is supported for rotation on a base 60 which is fixedly coupled to platform 30. Rotation of guide turntable 14 relative to base 60 can be provided by any means known in the art for rotating a turntable relative to a base. In a preferred embodiment of the present invention, a plurality of guide bearings 62 are disposed between an upper surface of base 60 and a lower surface of guide turntable 14. Guide bearings 62 substantially reduce friction between base 60 and guide turntable 14 and allow guide turntable 14 to be rotated relative to base 60 on a central axis 64 (shown in FIG. 4). Base 60 presents a lip 66 which prevents lateral movement of guide turntable 14 relative to base 60. Guide motor 32 provides for the rotation of guide turntable 14 at various speeds and in different directions. Guide motor 32 can be any rotating power actuator known in the art such as, for example, a hydraulic motor or an electric motor. As perhaps best shown in FIG. 3, guide motor 32 is preferably fixedly coupled to platform 30 and rotates a guide gear 68 via a drive shaft 70. Guide gear 68 mates with corresponding teeth formed on the outer edge of guide turntable 14 so that rotation of guide gear 68 causes corresponding rotation of guide turntable 14.

Referring again to FIGS. 2–5, reel turntable 16 can be supported for rotation relative to guide turntable 14 and platform 30 on central axis 64 (shown in FIG. 4) by any means known in the art for rotating a turntable on a base. In a preferred embodiment of the present invention, reel turntable 16 is supported for rotation on, and relative to, guide turntable 14. A plurality of reel bearings 72 are disposed between an upper surface of guide turntable 14 and a lower surface of reel turntable 16. Reel bearings 72 substantially reduce friction between guide turntable 14 and reel turntable 16 and allow reel turntable 16 to be rotated relative to guide turntable 14 on central axis 64 (shown in FIG. 4). Reel turntable 16 presents projections 74 which prevent lateral movement of reel turntable 16 relative to guide turntable 14. Reel motor 34 provides for the rotation of reel turntable 16 relative to guide turntable 14 at various speeds and in different directions. Reel motor 34 can be any rotating power actuator known in the art such as, for example, a hydraulic motor or an electric motor. As perhaps best shown in FIG. 3, reel motor 34 is preferably fixedly coupled to guide turntable 14 and is operable to rotate a reel gear 76 via a draft shaft 78. Reel gear 76 mates with corresponding teeth formed on the outer edge of reel turntable 16 so that rotation of reel gear 76 causes corresponding rotation of reel turntable 16.

Figure 3:
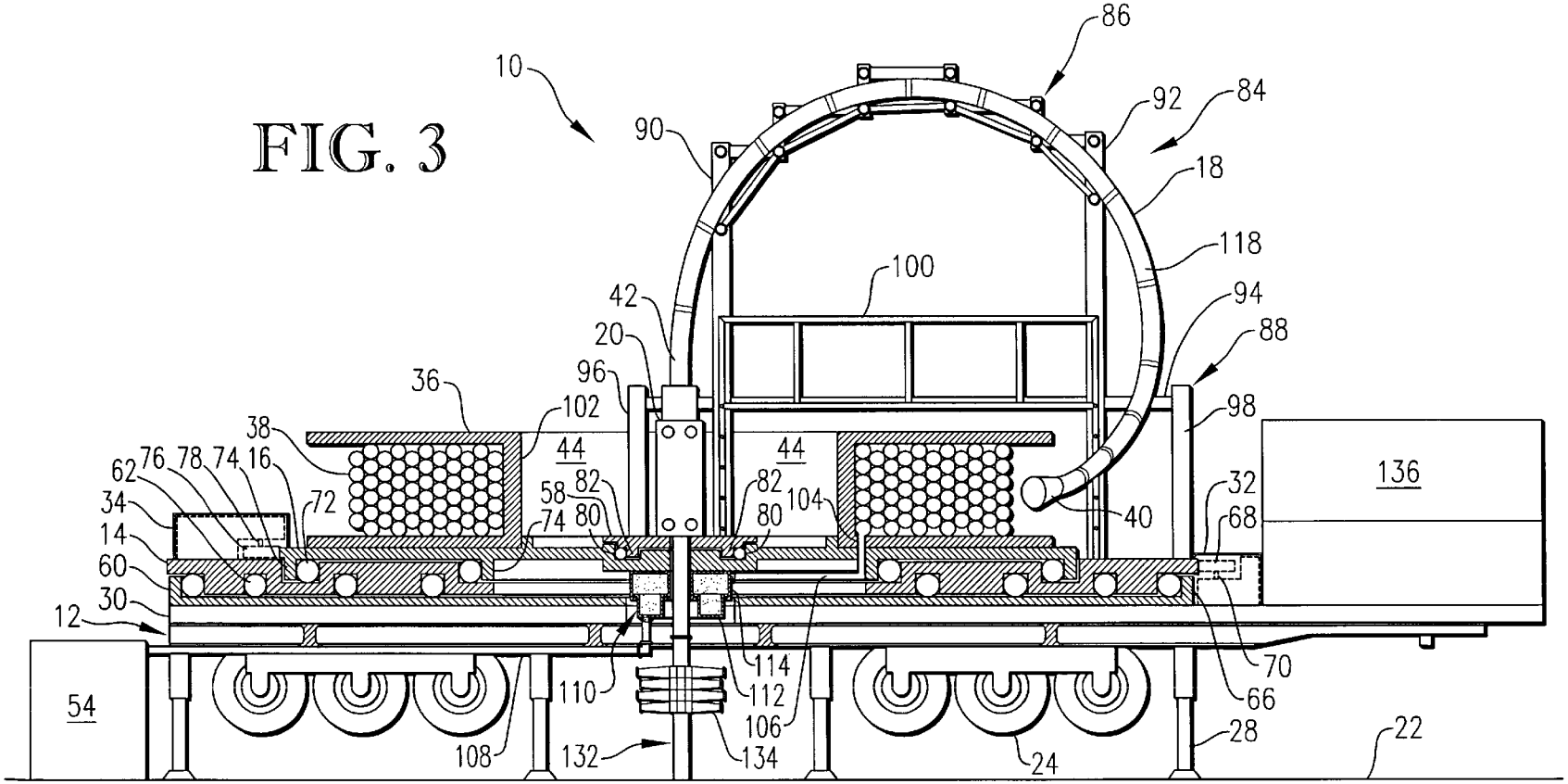
FIG. 3 is a partial sectional view of the coiled tubing rig taken along line 3—3 in FIG. 5.
Figure 5:
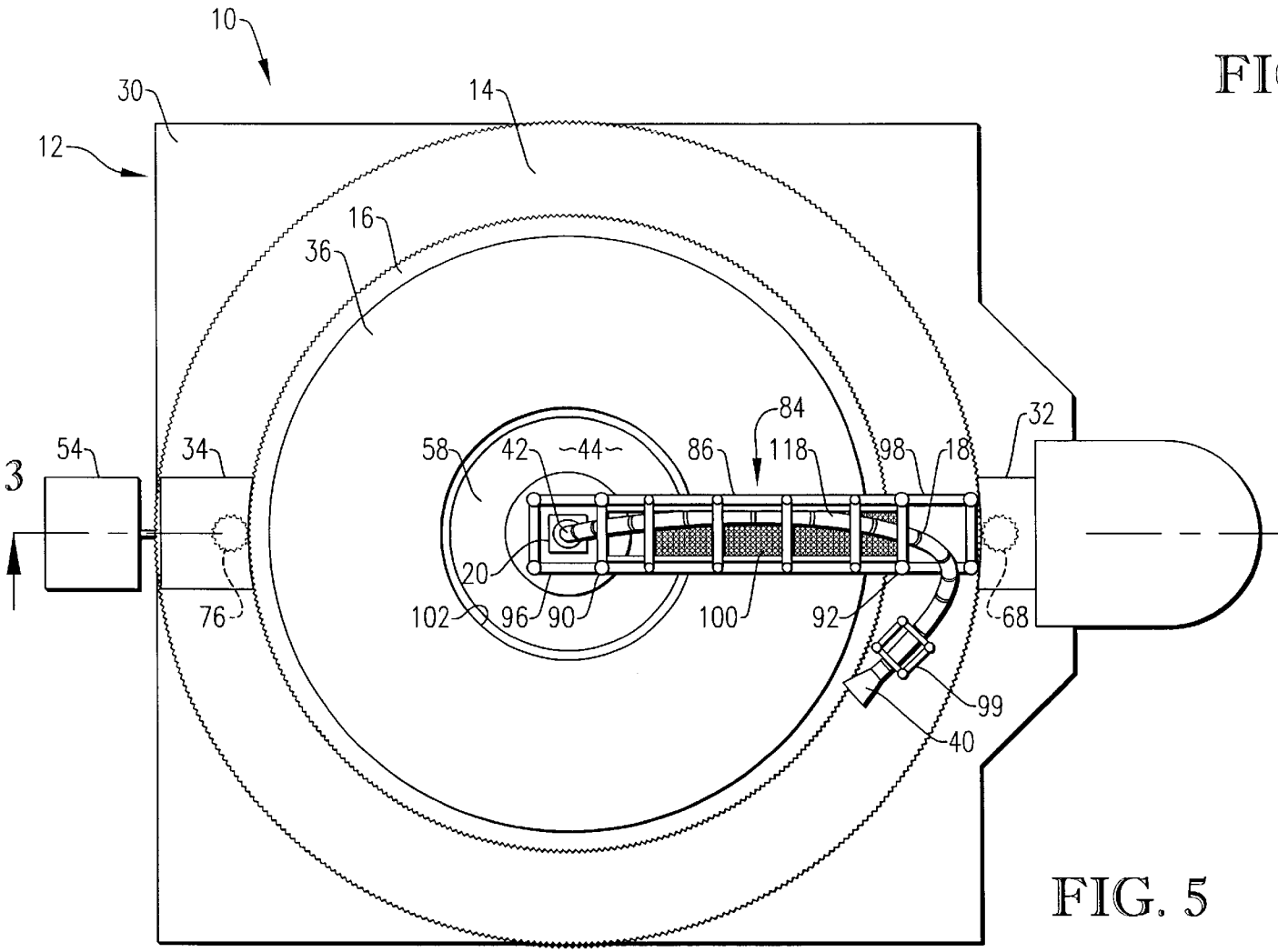
FIG. 5 is a top view of the coiled tubing rig.

Referring now to FIGS. 3–5, injector turntable 58 can be supported for rotation relative to reel turntable 16 and platform 30 on central axis 64 (shown in FIG. 4) by any means known in the art for rotating a turntable relative to a base. In a preferred embodiment of the present invention, injector turntable 58 is supported for rotation on, and relative to, reel turntable 16. A plurality of injector bearings 80 are disposed between an upper surface of reel turntable 16 and a lower surface of injector turntable 58. Injector bearings 80 substantially reduce the friction between reel turntable 16 and injector turntable 58 and allow injector turntable 58 to be rotated relative to reel turntable 16 on central axis 64. Injector turntable 58 presents a projection 82 which is received in a recess of reel turntable 16 and prevents lateral shifting of injector turntable 58 relative to reel turntable 16. Injector turntable 58 is fixedly coupled to guide turntable 14 by a support structure 84 so that injector turntable 58 and guide turntable 14 rotate together, at the same rate and in the same direction.

Referring again to FIGS. 2–5, support structure 84 generally includes a upper portion 86 and a lower portion 88. Upper portion 86 is coupled to and extends between an inner vertical support 90 and an outer vertical support 92. Inner vertical support 90 is coupled to injector turntable 58 and outer vertical support 92 is coupled to guide turntable 14. Upper portion 86 is operable to support an upper portion of guide member 18 in a position generally over reel 36. Lower portion 88 includes a horizontal member 94 coupled to and extending between an injector support 96 and a guide support 98. Injector support 96 is coupled to power injector 20 and injector turntable 58 and is operable to support power injector 20 relative to injector turntable 58. Guide support 98 is coupled to guide turntable 14 and a lower portion of guide member 18 and cooperates with a secondary guide support 99 to support the lower portion of guide member 18 relative to guide turntable 14. Horizontal member 94 is preferably a strong, ridged member coupling injector support 96 to guide support 98 so that when guide turntable 14 is rotated by guide motor 32, injector turntable 58 rotates with guide turntable 14. A cat walk 100 can be provided between vertical supports 90 and 92 to provide access to power injector 20.

Reel 36 is supported by and rotates with reel turntable 16. Reel 36 is preferably substantially centered on central axis 64 (shown in FIG. 4) which is substantially aligned with the natural axis of rotation of reel 36. Reel 36 is supported for rotation on central axis 64 with central axis 64 being at least substantially upright. Preferably, central axis 64 is at least substantially vertical. Reel 36 is configured to hold coiled tubing 38 thereon in a wound position with the wound coiled tubing 38 being generally wound around central axis 64 (shown in FIG. 4). Reel 36 includes an inner wall 102 which defines opening 44. Opening 44 extends generally through the center of reel 36 in a direction which is at least substantially perpendicular to the direction of elongation of coiled tubing 38 wound around inner wall 102. Preferably, reel 36 is supported in a manner such that opening 44 extends along, and most preferably is centered on, central axis 64 (shown in FIG. 4). As perhaps best illustrated in FIG. 3, reel 36 further includes a fluid supply inlet 104 which allows a rotatable fluid supply line 106 to be fluidically coupled to an end of coiled tubing 38 which is disposed on reel 36 proximate inner wall 102. Drilling fluid from drilling fluid source 54 is supplied to coiled tubing 38 via a stationary fluid supply line 108, a rotatable fluid coupling 110, and rotatable fluid supply line 106.

Referring now to FIGS. 3 and 4, rotatable fluid coupling 110 is generally annular cylindrical in shape, having an opening therethrough, through which coiled tubing 38 may pass. A lower portion 112 of rotatable fluid coupling 110 is fluidically coupled to drilling fluid source 54 by stationary supply line 108. An upper portion of rotatable fluid coupling 110 is fluidically coupled to an end of coiled tubing 38 disposed on reel 36 by rotatable supply line 106. Lower portion 112 is fixedly coupled to ground support structure 12 by any means known in the art. Upper portion 114 is fixedly coupled to reel turntable 16 by any means known in the art. Thus, upper and lower portions 112 and 114 rotate relative to one another when reel turntable 16 is rotated relative to ground support structure 12. A sealing mechanism is located at the joint where upper and lower portions 114 and 112 of rotatable fluid coupling 110 are coupled. The sealing mechanism prevents fluid from leaking out of rotatable fluid coupling 110, even when upper and lower portions 114 and 112 are rotating relative to one another. Thus, rotatable fluid coupling 110 allows drilling fluid to be charged to coiled tubing 38 while reel 36 is being rotated relative to ground support structure 12.

Referring again to FIGS. 2–5, guide member 18 generally includes first end 40 for directing coiled tubing 38 on and off of reel 36, second end 42 for directing coiled tubing 38 into and out of power injector 20, and a generally curved body 118 extending between first and second ends 40 and 42 for guiding coiled tubing 38 generally over reel 36. As perhaps best seen in FIG. 7, body 118 of guide member 18 can be made of a plurality of interconnecting sections 120. Sections 120 can be connected by a collar 122 which receives and is secured between abutting ends of adjacent sections 120. Collar 122 preferably includes a plurality of rollers 124 for allowing coiled tubing 38 to be readily longitudinally translated through a curved internal passageway defined by guide member 18.

Referring again to FIGS. 2–5, a preferred embodiment of the present invention, the radius of curvature of the internal passageway defined by guide member 18 is, at all points, greater than the radius of curvature of coiled tubing 38 disposed on reel 36. Such a configuration minimizes bending stresses on coiled tubing 38 and, thus, failure due to fatigue is inhibited. Preferably, the radius of curvature of the internal passageway of guide member 18 proximate first end 40 is substantially the same as the radius of the curvature of coiled tubing 38 disposed on reel 36. Preferably, the radius of curvature of the internal passageway gradually increases between first end 40 and second end 42 until, at second end 42, the radius of curvature of the internal passageway is substantially infinite.

Power injector 20 is coupled to second end 42 of guide member 18. At second end 42 of guide member 18, coiled tubing 38 received in guide member 18 is aligned for substantially vertical extension through opening 44 in reel 36 and into borehole 46. Thus, the portion of coiled tubing 38 passing through power injector 20 is in a substantially straight, extended position. Referring now to FIG. 6, power injector 20 can be any conventional coiled tubing injector known in the art. In a preferred embodiment of the present invention, power injector 20 includes a pair of opposing tracks 126, each rotatably driven by a pair of drive wheels 128. Drive wheels 128 are coupled to any rotating power actuator known in the art such as, for example, a hydraulic or electric motor. Tracks 126 are equipped with a plurality of grippers 130. When coiled tubing 38 is received in power injector 20, at least a portion of coiled tubing 38 is disposed between tracks 126 and contacted by grippers 130. Tracks 126 exert a compressive force on the outside of coiled tubing 38 so that the frictional engagement force between grippers 130 and the outside surface of coiled tubing 38 is sufficient to allow coiled tubing 38 to be shifted relative to power injector 20 with grippers 130 as tracks 126 are rotated by drive wheels 128. The speed and direction of rotation of drive wheels 128 are preferably adjustable so that coiled tubing 38 can be advanced or retracted at different rates. As discussed above, the upper end of power injector 20 is coupled to second end 42 of guide member 18. The lower end of power injector 20 is coupled to injector turntable 58. Because guide turntable 14 and injector turntable 58 are coupled together by support structure 84, substantially no torsional force is exerted on power injector 20 by guide member 18 when guide member 18 is rotated by guide motor 32.

Referring now to FIGS. 1–4, between second end 42 of guide member 18 and the ground surface 22, coiled tubing 38 is in an extended position, wherein the radius of curvature of coiled tubing 38 is substantially infinite and the longitudinal axis of coiled tubing 38 is at least substantially aligned with central axis 64 (shown in FIG. 4). Between power injector 20 and ground surface 22, coiled tubing 38 passes through respective openings in injector turntable 58, reel turntable 16, guide turntable 14, rotatable fluid coupling 110, and a well head 132. The respective openings in injector turntable 58, reel turntable 16, guide turntable 14, rotatable fluid coupling 110, and well head 132 are preferably, at least substantially aligned with central axis 64 (shown in FIG. 4).

Well head 132 can extend between power injector 20 and ground surface 22. Well head 132 can include any components commonly found in the well head of a coiled tubing drilling operation such as, for example, blow out preventors 134, strippers, valves, tubing hangers, access windows, and/or risers. Below well head 132, coiled tubing 38 can extend into borehole 46.

Referring again to FIGS. 1–5, coiled tubing rig 10 can be used for many traditional coiled tubing operations such as, for example, workovers, completions, fishing operations, and drilling. The present invention provides a coiled tubing rig which allows for simultaneous rotation and translation of the coiled tubing relative to a subterranean formation. This simultaneous rotational and translational capability provides numerous advantages in all types of coiled tubing operations; however, the present invention is particularly advantageous in coiled tubing drilling operations.

When drilling a well using coiled tubing rig 10, coiled tubing 38 is first fed from reel 36 into the curved internal passageway defined within guide member 18, and then into power injector 20. Power injector 20 is used to shift coiled tubing 38 between the wound position on reel 36 and the extended position below second end 42 of guide member 18. Thus, power injector 20 provides for translational movement of coiled tubing 38 relative to subterranean formation 48. Power injector 20 and reel motor 34 are preferably controlled in a synchronized manner so that when power injector 20 pulls coiled tubing 38 off of reel 36, reel motor 34 rotates reel 36 to allow unwinding of coiled tubing 38. Further, when power injector 20 pulls coiled tubing 38 out of borehole 46, reel motor 34 rotates reel 36 to wind coiled tubing 38 onto reel 36.

To provide purely translational advancement of coiled tubing 38 into borehole 46, guide motor 32 is locked to prevent rotation of guide turntable 14 relative to platform 30, power injector 20 is actuated to pull coiled tubing 38 off of reel 36, and reel motor 34 is actuated to rotate reel turntable 16 relative to guide turntable 14 so that coiled tubing 18 can be spooled off of reel 36. As coiled tubing 38 is being spooled off of reel 36 by rotating reel 36 relative to guide member 18, power injector 20 pulls the unwound coiled tubing 38 through guide member 18 and then pushes unwound coiled tubing 38 through well head 132 and into borehole 46. To provide purely translational retraction of coiled tubing 38 out of borehole 46, the direction of operation of power injector 20 and reel turntable 16 are reversed so that power injector 20 pulls coiled tubing 38 out of borehole 46 and pushes coiled tubing 38 into guide member 18 while reel motor 34 rotates reel 36 relative to guide member 18 to thereby wind coiled tubing 38 back onto reel 36.

To provide for purely rotational movement of the portion of coiled tubing 38 extending into borehole 46, power injector 20 is locked to prevent shifting of coiled tubing 38 in and out of borehole 46, reel motor 34 is locked to prevent rotation of reel turntable 16 relative to guide turntable 14, and guide motor 32 is actuated to rotate guide turntable 14 relative to platform 30. Rotating guide turntable 14 causes guide member 18, power injector 20, injector turntable 58, and the portion of coiled tubing 38 extending into borehole 46 to rotate relative to subterranean formation 48.

To provide for simultaneous rotation and translation of the portion of coiled tubing 38 extending into borehole 46, power injector 20, reel motor 34, and guide motor 32 are simultaneously actuated. Power injector 20 and reel motor 34 cooperate to longitudinally shift coiled tubing 38 between the wound position on reel 36 and the extended position in borehole 46. At the same time, guide turntable 14 is rotated relative to platform 30 to thereby rotate the portion of coiled tubing 38 extending in borehole 46 relative to subterranean formation 48. Further, drill bit 56 can be simultaneously rotated relative to coiled tubing 38 by pumping pressurized drilling fluid from drilling fluid source 54 into coiled tubing 38.

Power injector 20, reel motor 34, and guide motor 32 can be powered by any means known in the art such as, for example, hydraulic or electrical means. A power source 136 can be provided with ground support structure 12 to provide power to power injector 20, reel motor 34, guide motor 32, and/or other components of coiled tubing rig 10. Power source 136 can provide, for example, electrical power, hydraulic power, or both electrical and hydraulic power. The speed and direction of power injector 20, reel motor 34, and guide motor 32 can be selectively controlled by any means known in the art for controlling the speed and direction of rotation of such power actuators.

The preferred forms of the invention described above are to be used as illustration only, and should not be utilized in a limiting sense in interpreting the scope of the present invention. Obvious modifications to the exemplary embodiments, as herein above set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. An apparatus for shifting an elongated flexible working member between a wound position on a reel and an extended position in a receiving opening, said reel having a reel axis and a reel opening extending through the reel along the reel axis, said apparatus comprising:

a guide member adapted to direct the working member between the wound position and the extended position;

a first powering device adapted to selectively rotate the reel on the reel axis; and a second powering device adapted to selectively move the guide member relative to the reel around the reel axis.

2. An apparatus as claimed in claim 1, said guide member configured so that the working member in the extended position is at least substantially longitudinally aligned with the reel axis.

3. An apparatus as claimed in claim 2; and a support adapted to support the reel generally above the receiving opening.

4. An apparatus as claimed in claim 3, said support adapted to maintain the reel axis in a substantially upright position.

5. An apparatus as claimed in claim 4, said support adapted to at least substantially align the reel axis with the receiving opening.

6. An apparatus as claimed in claim 1, said guide member adapted to direct the working member between the wound position and a position in which the working member is aligned for extension through the reel opening.

7. An apparatus as claimed in claim 1, said guide member defining a curved passageway for shiftably receiving at least a portion of the working member, said guide member including a first end for directing the working member between the wound position and the passageway, said guide member including a second end for directing the working member between the passageway and the extended position.

8. An apparatus as claimed in claim 7; and a power injector coupled to the second end and operable to translate the working member relative to the guide member.

9. An apparatus for selectively shifting coiled tubing into and out of a borehole extending into a subterranean formation, said apparatus comprising:

a reel adapted to store the coiled tubing in a wound position thereon, said reel including a reel opening extending therethrough; and a guide member adapted to direct the coiled tubing from the wound position to a position in which the coiled tubing is aligned for extension through the reel opening.

10. An apparatus as claimed in claim 9, said reel and said guide member being selectively rotatable relative to one another.

11. An apparatus as claimed in claim 9, said reel and said guide member being selectively rotatable relative to one another on a common axis of rotation.

12. An apparatus as claimed in claim 11, said common axis of rotation having a substantially upright orientation.

13. An apparatus as claimed in claim 12, said common axis of rotation being at least substantially aligned with the reel opening.

14. An apparatus as claimed in claim 13; and a support for supporting the reel so that the reel opening is positioned generally above the borehole.

15. An apparatus as claimed in claim 14, said reel and said guide member configured so that at least a portion of the coiled tubing can be extended through the reel opening and into the borehole.

16. An apparatus as claimed in claim 15; and a power injector coupled to the guide member and operable to translate the coiled tubing relative to the guide member.

17. A drilling rig for drilling a borehole in a subterranean formation using coiled tubing, said coiled tubing being at least partially disposed in a wound position on a reel, said reel defining a reel axis and a reel opening extending through the reel along the reel axis, said drilling rig providing simultaneous rotation and translation of the coiled tubing relative to the subterranean formation, said drilling rig comprising:

a reel support adapted to support the reel in a position wherein the reel axis is at least substantially upright;

a guide member adapted to direct the coiled tubing between the wound position and a position in which the coiled tubing is aligned for extension through the reel opening; and a power injector for translating the tubing relative to the guide member.

18. A drilling rig as claimed in claim 17, said guide member adapted to be selectively moveable around the reel axis.

19. A drilling rig as claimed in claim 18, said reel support adapted to selectively rotate the reel relative to the guide member on the reel axis.

20. A drilling rig as claimed in claim 17, said power injector being coupled to the guide member.

21. A drilling rig as claimed in claim 20, said power injector being rotatable relative to the reel on the reel axis.

22. A drilling rig as claimed in claim 17; and a guide support to which the guide member and the power injector are coupled.

23. A drilling rig as claimed in claim 22, said reel support and said guide support being rotatable relative to one another on a common axis of rotation.

24. A drilling rig as claimed in claim 23, said reel support and said guide support each defining a respective support opening adapted to be at least partially aligned with the reel opening.

25. A drilling rig as claimed in claim 24, said reel support, said guide support, and said guide member configured so that at least a portion of the coiled tubing extends through the reel opening, through the support openings, and into the borehole.

26. A method of shifting an elongated flexible tubing in and out of a bore, said tubing being wound around an axially extending opening in a reel, said tubing including an inner portion positioned proximate the opening and an outer portion positioned radially outward from the inner portion, said method comprising the steps of:

(a) unwinding a length of the outer portion of the tubing off of the reel; and (b) directing the unwound portion of the tubing through the opening in the reel and into the bore.

27. A method as claimed in claim 26; and (c) positioning the reel generally over the bore.

28. A method as claimed in claim 27; and (d) aligning the opening in the reel with the bore.

29. A method as claimed in claim 28, step (a) including the step of actuating a power injector.

30. A method as claimed in claim 29, step (a) including the step of rotating the reel on a reel axis.

31. A method as claimed in claim 26, step (b) including the step of positioning at least a portion of the tubing in a curved passageway defined by a substantially rigid guide member.

32. A method as claimed in claim 31; and (e) rotating the guide member relative to the bore to thereby rotate the portion of the tubing located in the bore relative to the bore.

33. A method of shifting an elongated flexible tubing in and out of a bore, said method comprising the steps of:

(a) unwinding a length of the tubing off of a reel around which at least part of the tubing is wound, actuating a power injector, and rotating the reel on a reel axis;

(b) directing the unwound portion of the tubing through an opening in the reel and into the bore and positioning at least a portion of the tubing in a curved passageway defined by a substantially rigid guide member, step (b) including the step of positioning at least a portion of the tubing in a curved passageway defined by a substantially rigid guide member;

(c) rotating the guide member relative to the bore to thereby rotate the portion of the tubing located in the bore relative to the bore; and (d) simultaneously with step (c) actuating a power injector to thereby cause translation of the portion of the tubing located in the bore relative to the bore.

34. A method of drilling a borehole in a subterranean formation, said method comprising the steps of:

(a) positioning a rotatable reel so that a reel axis of rotation of the reel is at least substantially upright, said reel having a reel opening which extends through the reel at least substantially along the reel axis of rotation;

(b) unwinding a portion of a coiled tubing off of the reel;

(c) positioning at least a portion of the unwound coiled tubing in a guide member which directs the unwound coiled tubing generally downward through the reel opening and into an extended position;

(d) rotating the guide member relative to subterranean formation to thereby cause rotation of the coiled tubing in the extended position relative to the subterranean formation; and (e) simultaneously with step (d), actuating a power injector to thereby cause translation of the coiled tubing in the extended position relative to the subterranean formation.

35. A method a claimed in claim 34; and (f) simultaneously with step (e), rotating the guide member and the reel relative to one another.

* * * * *